US005900176A

United States Patent [19]

Tassicker et al.

[11] Patent Number: 5,900,176

[45] Date of Patent: May 4, 1999

[54] PROTECTIVE DEVICE FOR SOLAR HOT WATER SYSTEMS

[75] Inventors: Phillip Graham Tassicker, Adelaide Airport; Friedrich Edward Berrer, Armadale, both of Australia

[73] Assignee: Hardie Energy Products Pty Ltd, Welshpool, Australia

[21] Appl. No.: 08/591,590

[22] PCT Filed: Aug. 9, 1994

[86] PCT No.: PCT/AU94/00460

§ 371 Date: Sep. 2, 1997

§ 102(e) Date: Sep. 2, 1997

[87] PCT Pub. No.: WO95/04905

PCT Pub. Date: Feb. 16, 1995

[30] Foreign Application Priority Data

Aug. 10, 1993 [AU] Australia ..... PM0466
Oct. 27, 1993 [AU] Australia ..... PM2032

[51] Int. Cl.[6] ..... H05B 1/02

[52] U.S. Cl. ..... 219/481; 219/517; 219/508; 219/494

[58] Field of Search ..... 219/508–513, 219/516, 517, 494, 497, 501, 505, 474, 480, 481

[56] References Cited

FOREIGN PATENT DOCUMENTS 7612487 7/1986 Australia .
3180893 1/1992 Australia .
3212693 2/1993 Australia .
8008684 4/1980 France .

*Primary Examiner*—Mark H. Paschall
*Attorney, Agent, or Firm*—Howard & Howard

[57] ABSTRACT

A temperature sensitive protective device for a solar water heater comprising an electric heater (12) for heating water and an electrical circuit for controlling electrical power to said electric heater. A first switch (22) in the circuit controls electrical power to the electric heater and an actuator is moveable to an activated position for operating the first switch means (22) to discontinue electrical power to the electric heater. A fusible link (24) is attached to the actuator for preventing the actuator from operating, and a second switch is disposed in the said circuit for controlling electrical power to the fuisible link when actuated for breaking the fusible link to release the actuator. A safety thermostat senses the temperature of the water and actuates the second switch in response to a predetermined temperature of the water and a biasing operates the actuator upon the release of the actuator by the fusible link. The electric heater is automatically disabled by the first switch in response to movement of the actuator by the biasing as a result of breaking of the fusible link by actuation of the second switch by the safety thermostat.

8 Claims, 4 Drawing Sheets

10
T1
18
22
24
26
28
FUSIBLE RESISTOR
20
12
HEATING ELEMENT
9
14

10
T1
18
24
20
FUSIBLE LINK
12
HEATING ELEMENT
22
14
109

36
38
140
152
16
24
142
148
132
150
130
126
128

PROTECTIVE DEVICE FOR SOLAR HOT WATER SYSTEMS

The present invention relates to a temperature sensitive protective device for solar hot water systems.

FIELD OF THE INVENTION

It is a requirement of the Australian Standards and other electrical safety codes that an electric hot water system be fitted with an electrical cut-out device (ECO) which safeguards against failure of the control thermostat.

Normally, the control thermostat senses the temperature of the water in the hot water system and makes an electric circuit to the heating element when the water temperature fills below the thermostat set point. When the water temperature rises to above the set point, the circuit is broken and the heating element is de-energised. The ECO is provided to protect the system in the event of the contact of the control thermostat becoming locked in the closed position. The ECO senses the water temperature and if it rises to 95° C. or thereabouts failure of the control thermostat is inferred. The ECO then activates and breaks the electrical circuit to the heating element.

The codes require that the ECO be a device which does not automatically reset. It is a requirement that a technician manually reset the device in the event of activation. In the case of solar hot water systems, it is possible for the water to approach 95° C. as a result of energy input by the solar collectors. Hence, it is desirable that the ECO distinguish between the water being heated by solar energy and electrical energy, otherwise the device will activate whenever the water temperature rises to about 95° C. regardless of the cause of the temperature rise.

The present invention provides a means by which, in a solar water heater with an electric booster the ECO can distinguish between a rise in temperature brought about by electric means or by solar energy.

SUMMARY OF THE INVENTION

In accordance with a first aspect of the present invention there is provided a temperature sensitive protective device for a solar water heater comprising an electric booster characterized by a first and a second automatically resetting thermostat, a resilient means, an actuator, a first switch means and a second switch means and a fusible resistor, the first and second thermostats being in either a closed state or an open state and the first and second switch means being in either a closed state or an open state, wherein the first thermostat normally changes state at a first relatively low temperature and the second thermostat normally changes state at a second relatively high temperature, the fuisible resistor normally holding the resilient means in a compressed state, power for the electric booster being supplied via an electrical circuit through the second switch means, whereby if the first thermostat does not change state above the first temperature and the second thermostat then changes state, the electrical circuit supplying the electric booster is automatically disabled by the first stitch means being caused to change state, the fuisible resistor fusing and disintegrating thereby releasing the resident means, the released resilient means then urging the actuator so as to change the state of the second switch means and thus removing power to the electric booster.

BRIEF DESCRIPTION OF THE DRAWINGS

The present invention will now be described, by way of example, with reference to the accompanying drawings, in which.

DESCRIPTION OF THE INVENTION

Figure 1:
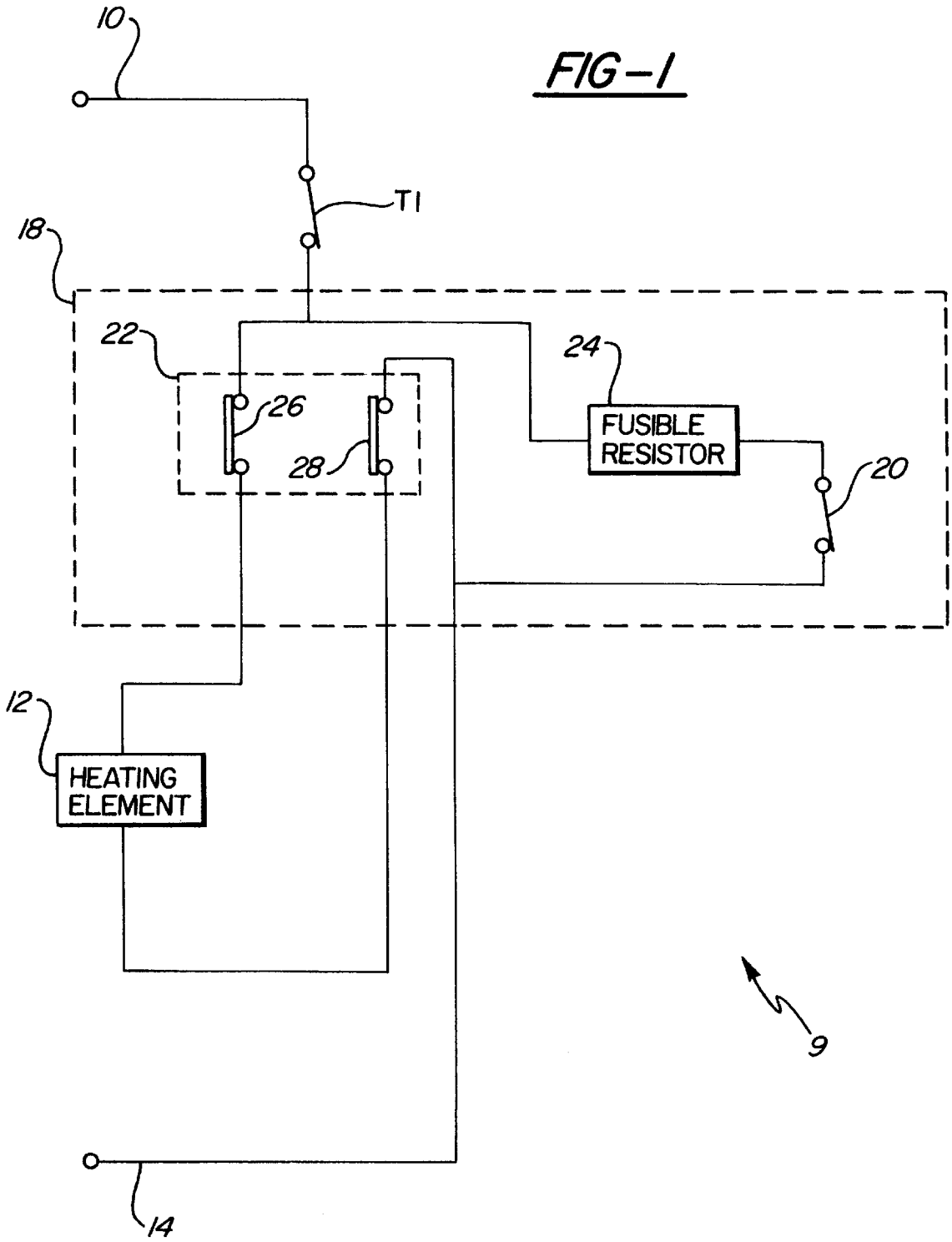
FIG. 1 is a schematic circuit diagram of a first embodiment of a temperature sensitive protective device in accordance with of the present invention.
Figure 2:
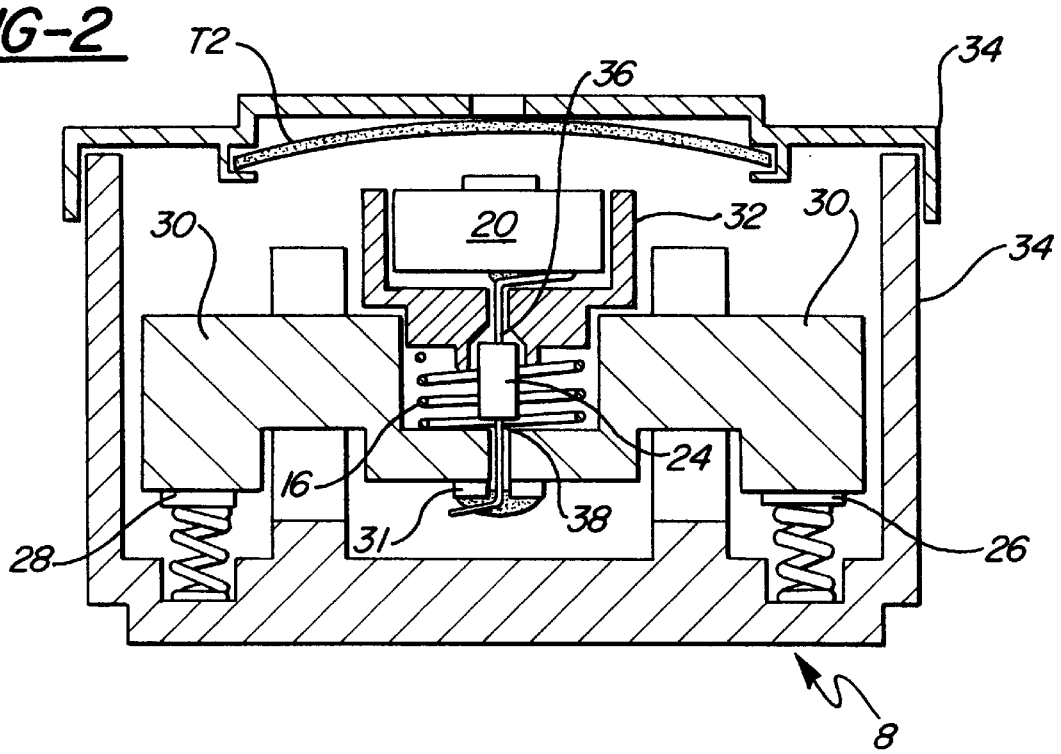
FIG. 2 is a sectional view of a temperature sensitive protective device incorporating the electric circuit of FIG. 1.

In FIGS. 1 and 2, there is shown a first embodiment of a temperature sensitive protective device 8 for solar hot water systems. In FIG. 1 there is shown a circuit 9 comprising an electrical power supply line 10, an electrical heating element 12 and an electrical neutral line 14.

The power supply line 10 includes a first automatically resetting thermostat T1 which operates in conventional manner such that when the water temperature falls below a certain level the thermostat T1 is closed so as to energise the heating element 12. When the temperature of the water again rises to the certain level, the thermostat T1 opens automatically and the heating element 12 is de-energised and cuts out.

However, problems can are where the thermostat T1 becomes locked in the closed position and the heating element 12 remains energised even when the water temperature rises above the usual cut out temperature.

Thus, means have to be provided to protect the circuit such that when the temperature of the water approaches an elevated temperature of say, 95° C. because of operation of the heating element 12, the booster element 12 will be de-energised.

In the circuit 9 shown in FIG. 1, this is achieved by the temperature sensitive protective device 8, which temperature sensitive protection device 8 comprises a second safety thermostat T2 (shown in FIG. 2), a spring 16 (shown in FIG. 2, an associated electrical circuit 18 and the thermostat T1.

The circuit 18 comprises a first switch 20, a second switch 22, and a fusible resistor 24. The second switch 22 composes first contact 26 and a second contact 28. The first contact 26 is in the power supply line 10 to the heating element 12 and the second contact 28 is in the neutral line 14 to the heating element 12. The contacts 26 and 28 of the second switch 22 are arranged to be closed under normal operating conditions, for example by spring loading or any other convenient means The first switch 20 is arranged such that opening of the second thermostat T2 urges the first switch 20 to close.

Shown in FIG. 2 is a sectional view of the temperature sensitive protective device 8, with like numeral denoting like parts to those shown in FIG. 1. The temperature sensitive protective device 8 further comprises an actuator 30. There is additionally shown a switch housing 32 and a thermostat housing 34. The thermostat housing 34 is of known type. The second thermostat T2 is shown in FIG. 2 in the closed position, and can be of any convenient type, such as a cycling disc. The first switch 20 is positioned in the switch housing 32. Connected to the first switch 20 is a first end 36 of the fusible resistor 24 by any convenient mean s, such as soldering, so that the switch housing 32 is positioned therebetween. A second end 38 of the fusible resistor 24 is connected to a metallic plate 31.

The spring 16 is held in a compressed state between the switch housing 32 and the actuator 30 by means of the fusible resistor 24 preventing the switch housing 32 and the actuator 30 from being pushed apart. The switch housing 32 and the actuator 30 are held between the first switch 20 and the metallic plate 31.

Under normal operating conditions, the contacts 26 and 28 of the second switch 22 remain closed, allowing power to the heating element 12. Further, since the second thermostat T2 is closed, the first switch 20 is open, thereby preventing current flow through the fuisible resistor 24.

However, if the first thermostat T1 becomes locked closed and the temperature of the water continues to rise to about 95° C. because of operation of the heating element 12 the second thermostat T2 opens. This causes the first switch 20 to close, resulting in a large current flow through the fusible resistor 24. The large current flow fuses the fusible resistor 24, thereby disintegrating the fusible resistor 24 and releasing the spring 16. The spring 16 then urges biases the actuator 30 and the switch housing 32 apart. The movement of the switch housing 32 is restricted by the thermostat housing 34, thus the actuator 30 is pushed onto the contacts 26 and 28 of the second switch 22. The biasing of the spring 16 is strong enough to overcome the spring loading or other means holding the contacts 26 and 28 of the second switch 22 closed. Consequently, the contacts 26 and 28 of the second switch 22 are opened, removing power to the heating element 12. The contacts 26 and 28 of the second switch 22 will remain open until the fuisible resistor 24 is replaced and the spring 16 reset.

Hence, in the event of a malfunction in the first thermostat Ti, power to the heating element 12 is cut off and remains cut off whilst the fusible resistor 24 is fused. On the other hand, if the water temperature approached 95° C. because of input of solar energy, the thermostat T1 is open when the thermostat T2 opens and the first switch 20 closes. In this situation, there is no power to the fusible resistor 24, hence the resistor 24 is not fused and the contacts 26 and 28 of the second switch 22 remain closed.

Thus, when the water temperature subsequently falls, the thermostat T2 closes automatically, opening the first switch 20 and enabling the heating element 12 to be energised in the normal way when the first thermostat T1 closes when the temperature falls to the required level.

Figure 4:
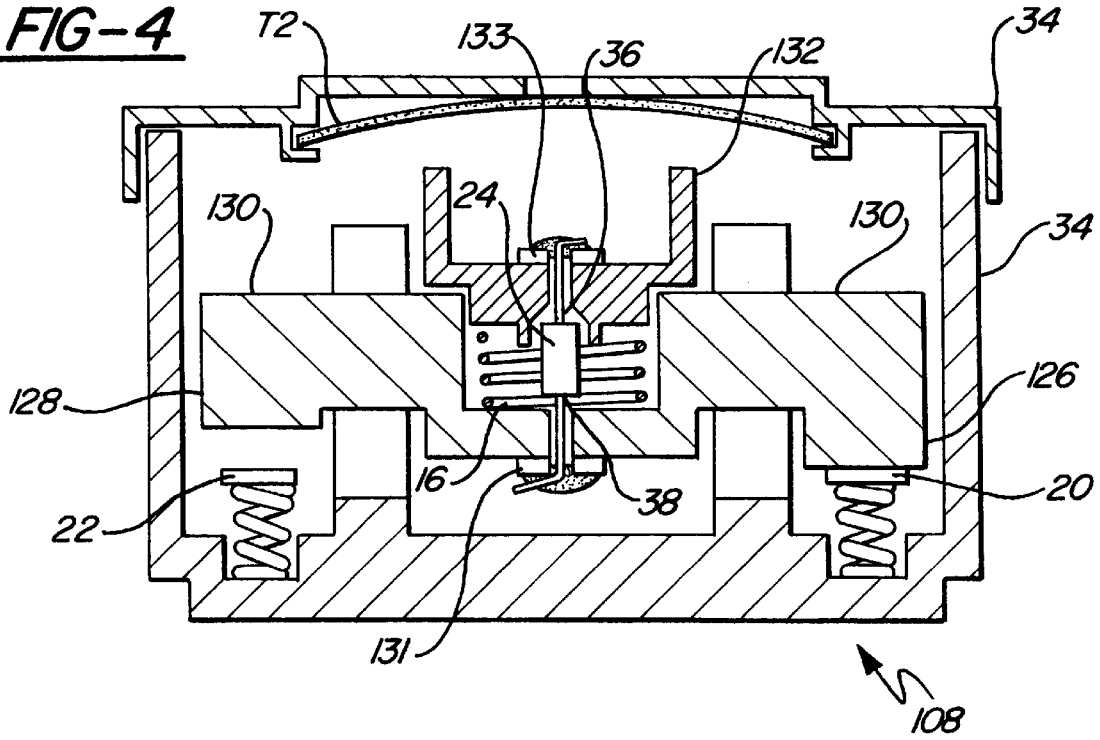
FIG. 4 is a sectional view of a temperature sensitive protective device incorporating the electrical circuit of FIG. 3.
Figure 3:
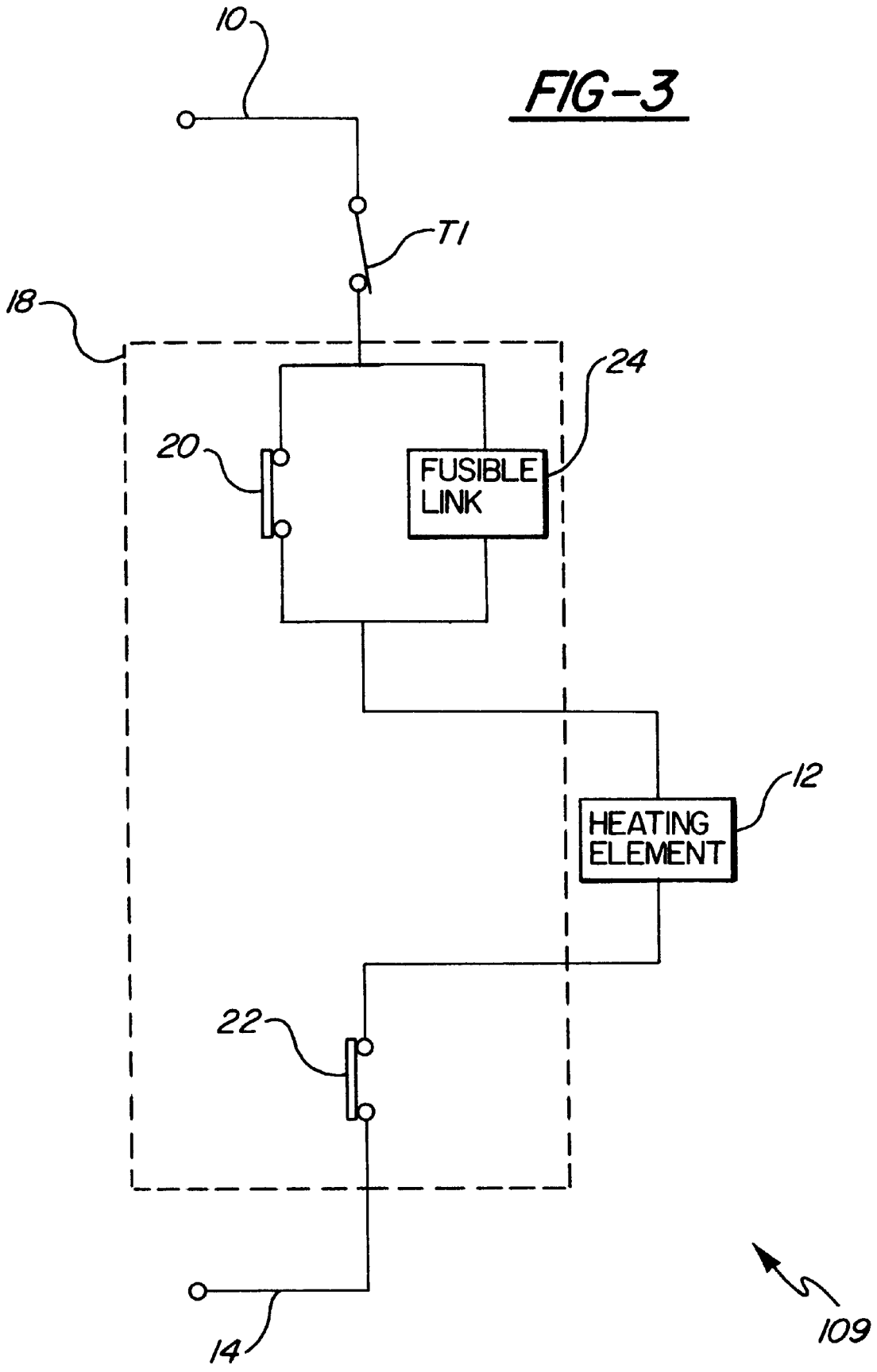
FIG. 3 is a schematic circuit diagram of a second embodiment of a temperature sensitive protective device in accordance with the present invention.

In FIGS. 3 and 4, there is shown a second embodiment of a temperature sensitive protective device 108 for solar hot water systems, like reference numerals denoting like parts. In FIG. 3, there is shown a Circuit 109 comprising an electrical power supply line 10, an electrical heating element 12 and an electrical neutral line 14.

The power supply line 10 includes a first automatically resetting thermostat T1 which operates in conventional manner such that when the water temperature falls below a certain level the thermostat T1 is closed so as to energise the heating element 12. When the temperature of the water again rises to the certain level, the thermostat T1 opens automatically and the heating element 12 is de-energised and cuts out.

In the circuit 109 shown in FIG. 3, this is achieved by the temperature sensitive protective device 108, which temperature sensitive protective device 108 comprises a second automatically resetting thermostat T2 (shown in FIG. 4), a spring 16 (shown in FIG. 4) and an associated elemental circuit 18 and the first thermostat T1.

The circuit 18 comprises a first switch 20, a second switch 22, and a fuisible resistor 24. The switches 20 and 22 are arranged to be closed under normal operating conditions, for example by spring loading or any other convenient means.

Shown in FIG. 4 is a sectional view of the temperature sensitive protective device 108, with like numerals denoting like parts to those shown in FIG. 3. The temperature sensitive protective device 108 further comprises an actuator 130. There is additionally shown a member 132 and a thermostat housing 34. The thermostat housing 34 is of known type. The second thermostat T2 is shown in FIG. 4 in the closed position, and can be of any convenient type, such as a cycling disc.

The actuator 130 has a first arm 126 and a second arm 128. The first arm 126 is positioned above the first switch 20 and the second arm 128 is positioned above the second switch 22. The second arm 128 is shorter than the first arm 126 as shown in FIG. 4. Extending through the member 132 is a first end 36 of the fusible resistor 24. The first end 36 of the fusible resistor 24 is connected to a metallic plate 133 by any convenient means, such as soldering. A second end 38 of the fusible resistor 24 extends through the actuator 130, and is connected to a metallic plate 131. The fusible resistor 24 is connected in an electrically parallel manner across the first switch 20 by known means as shown in FIG. 3. The spring 16 is held in a compressed state between the member 132 and the actuator 130 by means of the fusible resistor 24 preventing the member 132 and the actuator 130 from being pushed apart. The metallic plates 131 and 133, to which the fusible resistor 24 is connected, prevent the spring 16 pushing apart the member 132 and the actuator 130, as shown in FIG. 4. Under normal operating conditions, the switches 20 and 22 remain closed, allowing power to the heating element 12. Further, since the second thermostat T2 is closed, the first switch 20 is closed, thereby preventing current flow through the fuisible resistor 24.

However, if the first thermostat T1 becomes locked closed and the temperature of the water continues to rise to about 95° C. because of operation of the heating element 12 the second thermostat T2 opens. The opening of the second thermostat T2 pushes the member 132 and the actuator 130 towards the switches 20 and 22. The first am 126 of the actuator 130 thereby bears upon the first switch 20, opening the first switch 20.

However, since the second arm 128 of the actuator i 30 is shorter than the first arm 126, the second arm 128 does not contact the second switch 22 which therefore remains closed. When the first switch 20 opens a current flows through the fusible resistor 24 in electrical series with the heating element. The current flow fuses the fuisible resistor 24, thereby disintegrating the fuisible resistor 24 and releasing the spring 16. The spring 16 then urges the actuator 130 and th e member 132 apart. Movement of the member 132 is restricted by the thermostat housing 34, thus the actuator 130 is urged onto the switches 20 and 22, thereby ensuring both switches 20 and 22 are open. The spring 16 is strong enough to overcome the spring loading or other means which hold the switches 20 and 22 closed under normal operating conditions. Consequently, the switches 20 and 22 are opened, removing power to the heating element 12. The switches 20 and 22 will remain open until the fusible resistor 24 is replaced and the spring 16 reset.

Hence, in the event of a malfunction in the first thermostat T1, power to the heating element 12 is cut off and remains cut off whilst the fuisible resistor 24 is fused. On the other hand, if the water temperature approached 95° C. because of input of solar energy, the thermostat T1 is open when the thermostat T2 opens and the first switch 20 closes. In this situation, there is no power to the fusible resistor 24, hence the resistor 24 is not fused and the second switch 22 remains closed.

Thus, when the water temperature subsequently falls, the thermostat T2 closes automatically, closing the first switch 20 and enabling the heating element 12 to be energised in the normal way when the first thermostat T1 closes when the temperature falls to the required level.

Figure 5:
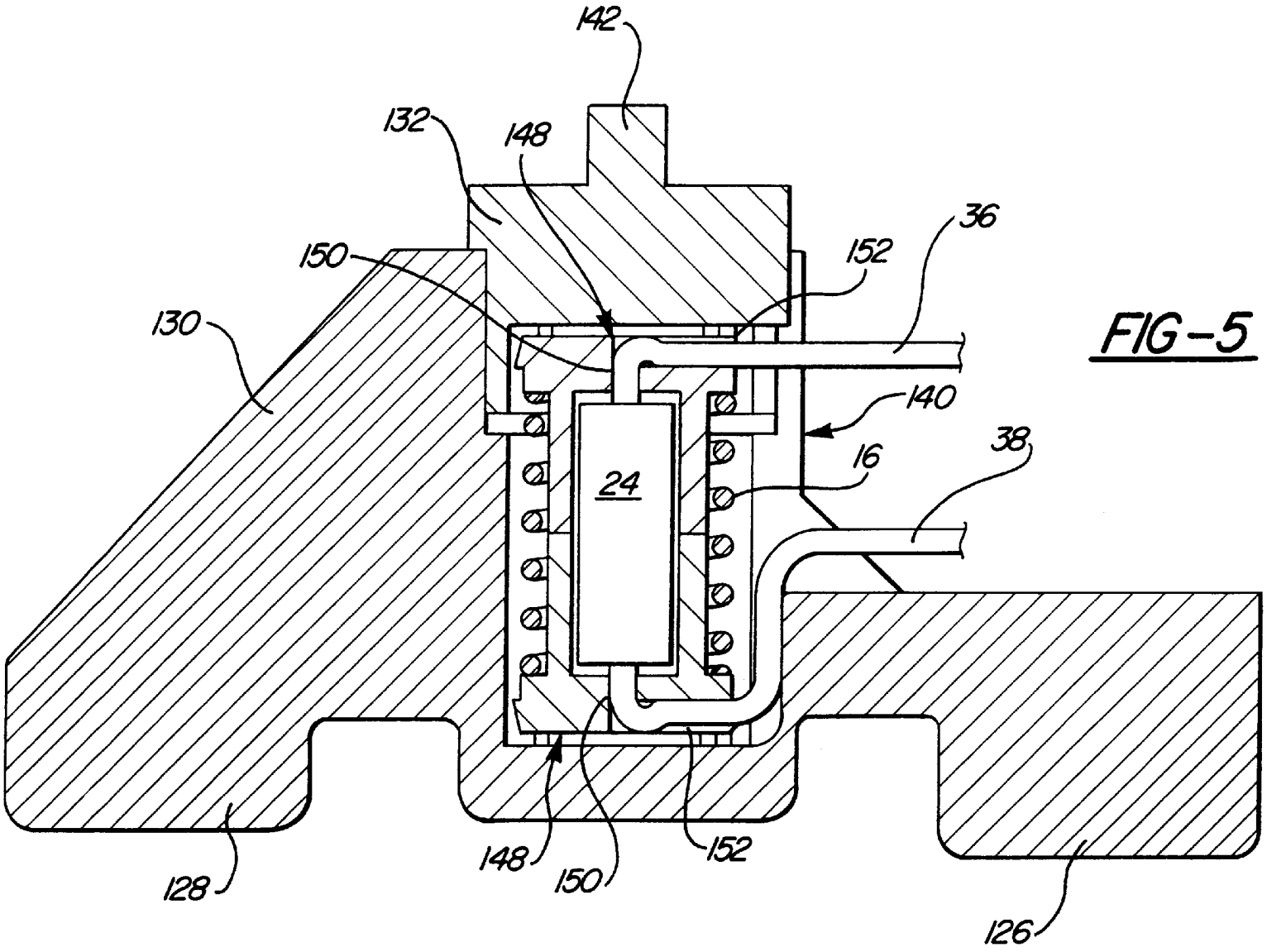
FIG. 5 is a sectional view of an alternative arrangement for use with the second embodiment of the present invention.

In FIG. 5 there is shown an alternative arrangement of the actuator 130 and the member 132 for use in the second embodiment shown in FIGS. 3 and 4. In the arrangement shown in FIG. 5 the actuator 130 has a cut away portion 140. The member 132 has a raised portion 142. The raised portion 142 allows the second thermostat T2 to bear upon the member 132 when the second thermostat T2 opens. Since the member 132 rests on the actuator 130 when the second thermostat T2 bears upon the raised portion 142 of the member 132 both the member 132 and the actuator 130 are pushed by the opening of the second thermostat T2.

Also shown in FIG. 5 are housing members 144 and 146. The housing members 144 and 146 are disposed within the actuator 130 and positioned so that the housing member 144 is in communication with the member 132. The fusible resistor 24 is housed within the housing members 144 and 146 as shown in FIG. 5. The housing members 144 and 146 are substantially cylindrical in form and have an end 148 which is closed, giving the housing members 144 and 146 a substantially U-shaped cross section. In each end 148 there is an aperture 150. In communication with the aperture 150 is a cut away portion 152. The first and second ends 36 and 38 of the fusible resistor 24 pass through the apertures 150 and along the cut away portion 152 as shown in FIG. 5. Consequently the spring 16 is held in a compressed site between the housing members 144 and 146 by the first and second ends 36 and 38 of the fusible resistor 24 being bent so as to prevent the housing members 144 and 146 from being pushed apart. Connected to the first and second ends 36 and 38, but not shown in FIG. 5, are wires or some other form of electrical connection to achieve the electrical circuit shown in FIG. 3.

It is envisaged that the alternative arrangement shown in FIG. 5 would replace the actuator 130 and the member 132 shown in FIG. 4.

In the arrangement shown in FIG. 5 when the fusible resistor 24 fuses and disintegrates the spring 16 is released, causing the housing members 144 and 146 to be pushed apart. Since the housing member 146 is resting upon the actuator 130, the housing member 144 is urged upwardly, thereby pushing the member 132 upwards. The member 132 is urged away from the actuator 130 until the member 132 can no longer be urged upwards due to limitations imposed by the thermostat housing 34. When this occurs the spring 16 will then urge the actuator 130 to bear upon the switches 20 and 22 as previously described. Modifications and variations such a would be apparent to a skilled addressee are deemed within the scope of the present invention.

We claim:

1. A temperature sensitive protective device for a solar water heater comprising;

an electric heater (12) for heating water, an electrical circuit for controlling electrical power to said electric heater, a first switch means (22) in said circuit for controlling electrical power to said electric heater, an actuator moveable to an activated position for operating said first switch means (22) to discontinue electrical power to said electric heater, a fusible link (24) attached to said actuator for preventing said actuator from operating, a second switch means in said circuit for controlling electrical power to said fusible link when actuated for breaking said fusible link to release said actuator, a safety thermostat for sensing the temperature of the water and for actuating said second switch means in response to a predetermined temperature of the water, and biasing means for operating said actuator upon said release of said actuator by the fusible link, whereby the electric heater is automatically disabled by said first switch means in response to movement of said actuator by said biasing means as a result of breaking of said fusible link by actuation of said second switch means by said safety thermostat.

2. A device as set forth in claim 1 wherein said electrical circuit includes a resetting thermostat for normally opening and closing to regulate the temperature of the water within a predetermined range.

3. A device as set forth in claim 1 wherein said safety thermostat and said second switch means are in electrical series.

4. A device as set forth in claim 1 wherein said safety thermostat comprises a cycling disc thermostat.

5. A device as set forth in claim 2 wherein said fusible link and said resetting thermostat are in electrical series.

6. A device as set forth in claim 5 wherein said fusible link and said first switch means are in electrical parallel with said electric heater and said second switch means.

7. A device as set forth in claim 1 wherein said fusible link and said first switch means are in electrical parallel.

8. device as set forth in claim 7 wherein said fusible link and said first switch means are in series with said electric heater and said second switch means.

* * * * *

UNITED STATES PATENT AND TRADEMARK OFFICE

CERTIFICATE OF CORRECTION

PATENT NO. : 5,900,176
DATED : May 4, 1999
INVENTOR(S) : Phillip Graham Tassicker, et. al.

It is certified that error appears in the above-identified patent and that said Letters Patent is hereby corrected as shown below:

Title page, item [73], Assignee: Delete Hardie Energy Products Pty Ltd., Welshpool, Australia and insert – Solahart Industries Pty Ltd. Welshpool, Australia --.

Signed and Sealed this
Fourth Day of January, 2000

*Attest:*

*Attesting Officer*

*Acting Commissioner of Patents and Trademarks*